US005099537A

United States Patent [19]

Denny

[11] Patent Number: 5,099,537

[45] Date of Patent: Mar. 31, 1992

[54] COMBINATION CLEANER AND REAMER FOR TUBES AND FITTINGS

[76] Inventor: Todd R. Denny, 1583 Sabina Way, San Jose, Calif. 95118

[21] Appl. No.: 540,230

[22] Filed: Jun. 19, 1990

[51] Int. Cl.[5] ..... A47L 15/00; A47L 25/00; B08B 1/00; B08B 7/00

[52] U.S. Cl. ..... 15/88; 15/104.03; 15/104.04; 15/104.05; 15/104.09

[58] Field of Search ..... 15/104.04, 104.05, 104.03, 15/104.09, 23, 88

[56] References Cited

U.S. PATENT DOCUMENTS

| | | | |
|---|---|---|---|
| 1,569,167 | 1/1926 | Anderson | 15/23 |
| 2,305,079 | 12/1942 | Heldenbrand | 15/104.04 |
| 2,758,326 | 8/1956 | Keely et al. | 15/23 |
| 2,859,627 | 11/1958 | Gallop, Jr. | 15/104.03 |
| 3,067,443 | 12/1962 | Romens | 15/104.03 |
| 3,134,202 | 5/1964 | Hoefler | 15/88 |
| 3,621,505 | 11/1971 | Vocker et al. | 15/104.04 |
| 4,014,062 | 3/1977 | Scott et al. | 15/104.04 |
| 4,467,489 | 8/1984 | Begneaud | 15/104.04 |
| 4,930,176 | 6/1990 | Gelman | 15/23 |

FOREIGN PATENT DOCUMENTS 8402292 6/1984 PCT Int'l Appl. ..... 15/104.04

*Primary Examiner*—Philip R. Coe
*Assistant Examiner*—Tony G. Soohoo
*Attorney, Agent, or Firm*—Robert Samuel Smith

[57] ABSTRACT

A Combination Cleaner Reamer for Tubes and Fittings includes a base plate housing. The ends of sleeves protrude from inside through a surface of the housing and the sleeves are bored to receive the stems of cylindrical brushes. A shaft extending from an opposite side of the housing may be coupled to the chuck of an electric hand drill or other power source to rotate all of the brushes simultaneously. A clamp secures the housing to the electric hand drill or motor. The apparatus and drill are easily separated from one another for convenient storage or portability purposes. Two types of brushes are mounted on the housing. One type is intended to brush the interior of the tube and has bristles extending from a central axis. The second type is intended to brush the exterior surface of the tube and includes bristles extending inwardly from the inside surface of a cylindrical shell. Several sets of internal and external brushes having a range of diameters are mounted in order to accomodate various sizes of tubes. A reamer may be substituted for one of the brushes.

13 Claims, 1 Drawing Sheet

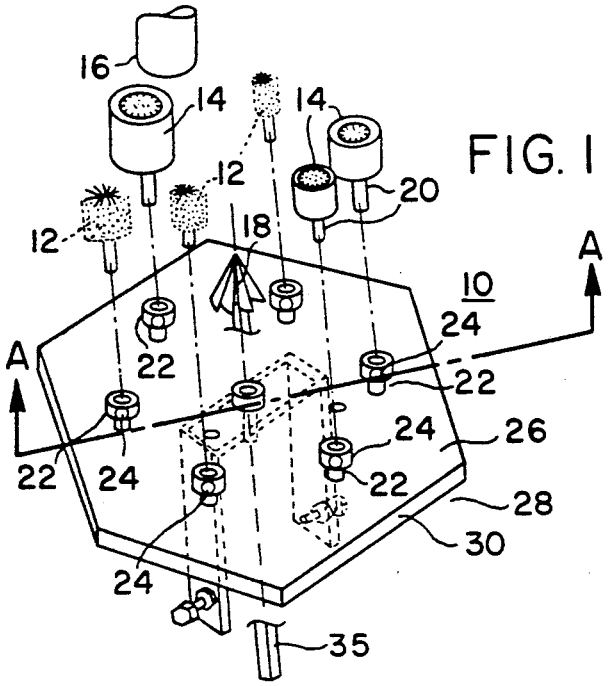
FIG. 1
FIG. 2
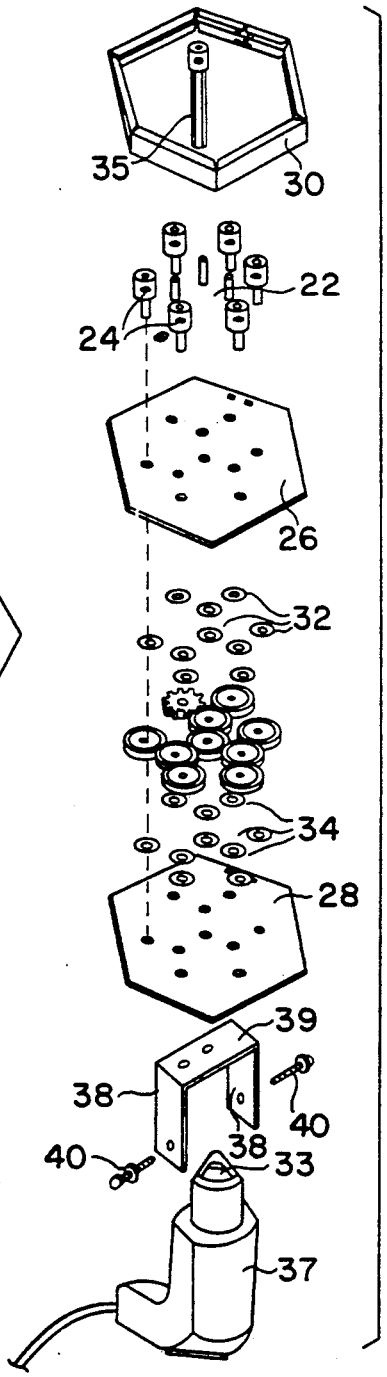
FIG. 3
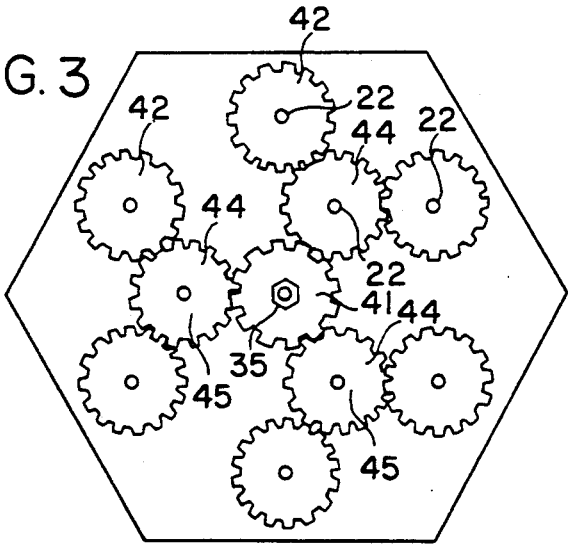
FIG. 4
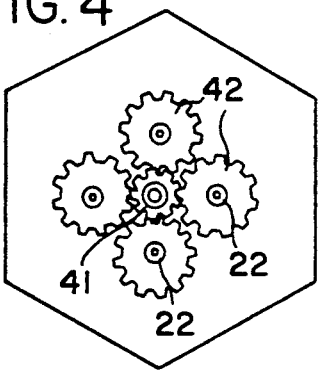

COMBINATION CLEANER AND REAMER FOR TUBES AND FITTINGS

FIELD OF THE INVENTION

This invention relates to devices for reaming and cleaning the ends of pipe, tubing and fittings and particularly to a combination cleaner and reamer that can accommodate various sizes, that is portable and can be powered by an electric hand drill.

BACKGROUND AND INFORMATION DISCLOSURE STATEMENT

Joining the ends of pipe, tubes or fittings to one another requires considerable care in order to avoid leaks and promote strength of the joint. Various situations, e.g., size of the pipe or fitting, location, number of connections to be made, etc., have resulted in the development of devices, cleaners, reamers, etc. that are useful for a particular situation.

One type of device is suitable for cleaning the threaded ends of large pipe.

For example, U.S. Pat. No. 4,403,353 to Hess discloses a housing which encloses an internal or external brush rotated by a flexible shaft and supplied continuously with cleaning fluid.

U.S. Pat. No. 4,433,448 to True discloses brushes adjustably attached to a rotating disk which may accommodate various sizes of pipe. The disk rotates to generate the brushing motion.

U.S. Pat. No. 3,274,630 to Miliekowski discloses scouring brushes between which cylindrical articles are rotatably interposed.

A number of styles of brushes are also disclosed that are intended for use as scrubbers for the ends of copper tube preparatory to soldering.

U.S. Pat. No. 4,914,063 to Bunke is a cylindrical brush with stepped diameter intended to brush the inside of tubes having any one of a number of diameters.

U.S. Pat. No. 4,852,549 to Criswell is for a brush comprising two concentric cylinders. The outer cylinder has bristles extending inward from its inner surface and the inner cylinder has bristles extending outwardly from its outer surface so as to define a space between the free ends of the bristles where a tube end may be interposed through a common open end of the cylinders. The supported other end of the cylindrical brushes is configured for detachable engagement with the chuck of an electric hand drill.

Yet another device, incorporated by reference into this specification, is marketed under the tradename PREPSTAR ™ by Card Industries, Inc., 3207 Washington Ave., St. Louis, Mo. 63103. This device is designed for bench mounting, has a radial cutting blade mounted on a hinge, a reamer, several cylindrical rotatable brushes of different sizes for brushing the insides of tube and a cylindrical brush for rotating the outside of the cut tube.

A workman is often confronted on the job with having to prepare for joining by soldering a large number of tube ends having any one of a number of diameters. The internal and external surface of the tube extending form the end to a distance of about one inch from the end must be thoroughly brushed (descaled) and deburred. None of the devices disclosed in the foregoing paragraphs provide the convenience in terms of portability and accommodation to quickly prepare different size tubes that is provided by the present invention.

In the context of mechanical design, the term "set" screw has two connotations. A set screw may refer to a screw having a special construction which is a screw body having no head but which has an allen socket on one end of the screw for receiving an allen wrench. The second connotation refers to a screw used in a construction to establish the position of one member with respect to the surface of an adjacent member. For such an application, a "set" screw may have any kind of head that is convenient for the application including an allen socket, an allen cap, a flat head, etc. In the context of this application, the term set screw as shown in FIG. 1 is used in the latter connotation.

THE INVENTION

Objects:

It is an object of this invention to provide a tool that may be used to deburr the end of a tube or fitting and to brush or descale the internal and external surface adjacent to the end to prepare the surface for soldering thereto.

Another object is that the tool be readily portable and stowable, e.g., in a workman's handcarried toolbox.

Another object is that the tool may be used to prepare tube having any one of a number of diameters.

Another object is that the user may be able to switch from one size tube to a different size tube conveniently and quickly.

Another object is that the tool be power driven rather than be manually operated.

Another object is that the tool be powered by attachment to a handheld electric drill in order to reduce the cost of the device and further improve portability.

Other objects achieved by this invention may become apparent to one after reading the description and studying the drawings.

Summary:

This invention is directed toward a base plate assembly on which is detachably mounted an array of brushes and a reamer and which is secured to an electric hand drill which rotates the brushes and reamer to deburr and scrub tube endings.

The base plate assembly includes a base plate and a cover plate held in an opposing position by a skirt to form a housing. Within the assembly housing is a plurality of sleeves, each having one end journaled into the baseplate and a second end journalled into the cover plate. Each sleeve has a central bore into which the stems of internal and external brushes are inserted through holes in the cover plate. The sleeves are all rotatably coupled to a central baseplate shaft. The shaft is also journaled through the base plate and cover plate and has a reamer on one end on a side of the base plate adjacent to the brushes Another end extending from the outer side of the base plate is attachable to the chuck of a handheld electric drill. Electric power applied to the drill causes the reamer and all of the brushes to rotate simultaneously. The connecting leg of a yoke is attached to the base plate and legs of the yoke have clamping screws to secure the drill to the base plate assembly as the brushes and reamer are rotated.

Each internal brush is cylindrical and has bristles extending outwardly from a central axis. The free ends of the bristles define a radius of the cylindrical brush selected to accommodate brushing the internal surface of a standard size tube. Each external brush includes a cylindrical shell whose inner surface is attached to bristles extending inward toward the axis of the cylinder. The exterior surface at the end of the tube is scrubbed when it is inserted into the interior of the rotating brush.

In one embodiment, the brushes are arranged on a circle whose center is the central baseplate shaft. The sleeves on which the brushes are mounted are rotatably coupled to the central baseplate shaft through gears, one mounted on each sleeve, which are engaged with idler gears journalled within the baseplate housing and which are, in turn, engaged with a gear on the central baseplate shaft.

Drawings

FIG. 1 is a perspective view of the cleaner/reamer of this invention.

FIG. 2 is an exploded view of FIG. 1.

FIG. 3 shows one embodiment of the gear arrangement.

FIG. 4 shows a second embodiment of the gear arrangement.

DETAILED DESCRIPTION OF THE BEST MODE

The following detailed description illustrates the invention by way of example and not by way of limitation of the principles of the invention. This description will clearly enable one skilled in the art to make and use the invention and describes several embodiments, adaptations, variations, alternatives and uses of the invention including what I presently believe to be the best mode of carrying out the invention.

FIG. 1 shows in perspective a top partially assembled view of the cleaner/reamer 10 of this invention with brushes (12, 14) positioned for slideable insertion into the apparatus. FIG. 2 shows an exploded view of the apparatus of FIG. 1. There are shown in FIGS. 1 internal brushes 12 for brushing the interior surfaces of tube ends and external brushes 14 for brushing the exterior surfaces of tube ends. (One tube end 16 is shown in FIG. 1 poised for brushing). A reamer 18 is also shown in the center of the array of brushes. Each brush and the reamer has a stem 20 that slides into a sleeve 22 where it is secured by a set screw 24. The sleeves 22 are rotatably mounted in a base plate assembly which includes a cover plate 26 and a base plate 28 joined by a skirt 30. Rotable mounting of each sleeve is accomplished with a bearing 32 in the cover plate aligned with a bearing 34 in the base plate so that each end of the sleeve is pressed into a bearing. The central stem, 35 is a hex bar (shown cutaway in FIG. 1) that extends through and beyond the bottom plate so that the hex stem may be detachably engaged with the jaws 33 of the chuck of an electric drill 37. The connecting member 39 of a U-strap is secured to the bottom plate so that the legs 38 extend on either side of the hand drill. A screw 40 on the free end of each leg maintains the position of the hand drill relative to the cleaner/reamer and holds the base plate assembly stationary with respect to the hand drill when the central hex stem and array of brushes is turning. These screws may be used as set screws set snugly enough against the sides of the hand drill to prevent the brush assembly from turning when power is applied to the hand drill yet still permit that the baseplate shaft may be simply released from the chuck and the drill slipped from between the legs when it is desired to use the hand drill to drill holes.

A number of gearing arrangements may be chosen to couple the brush stems to the central hex stem but the arrangement shown in FIG. 3 is preferred when it is required to have a rotational velocity of the brushes equal to or less than the rotational velocity of the central stem or when it is desired to turn the brushes in the same direction as the reamer. FIG. 3 is a cross sectional view taken through the base plate assembly along line of sight AA in FIG. 1. There is shown the central hex stem, 35, and sleeves 22 for the brush stems. A gear 42 is mounted onto each stem. Additionally, there are three planetary gears 44 that are rotably mounted on shafts 45 extending between the cover plate and base plate that couple the gears on the brush stems to the gear 41 on the base plate shaft 35.

The embodiment of FIGS. 1, 2 and 3 accomplish the objects of the invention which include a device that is portable and easily attached to an electric drill to drive an array of brushes and a reamer for cleaning the ends of various sizes of tube. Other embodiments become apparent as a result of studying the specification and drawings. For example, the gear of each brush stem may be coupled directly to a gear on the hex stem as shown in FIG. 4. Each brush could be a combination of an internal and external brush. A modification of the means of clamping the device to the drill may be introduced. The power means may be a motor with a straight shaft with a universal type coupling means for aligned attachment to the central stem. All of these embodiments are within the scope of the invention.

It should be understood that these and other various modifications can be made by one of ordinary skill in the art without departing from the spirit thereof. I therefore wish my invention to be defined by the scope of the appended claims as broadly as the prior art will permit and in view of the specification if need be.

I claim:

1. An apparatus for deburring and cleaning an end of a tube which comprises:

a baseplate having a first and second side;

a plurality of means for brushing, each brush means including a brush portion and a stem portion attached to said brush portion;

means for rotatably mounting said brush means onto said baseplate;

a baseplate shaft journalled into said baseplate with a first end extending from said first side and a second end extending from said second side;

means in operable combination with said rotatably mounting means and said baseplate shaft for continuously rotating said brush stems when said baseplate shaft continuously rotates;

a first leg having an end attached to said second side of said base plate and a first free end extended away from said second side with a set screw in said first leg near said first free end oriented perpendicular to said base plate shaft;

a second leg having an end attached to said second side of said base plate and a second free end extended away from said second side with a set screw in said second leg oriented perpendicular to said base plate shaft near said said second free end providing that said electric hand drill can be interposed between said free ends and secured by said screws engaged with opposing sides of said electric hand drill, thereby preventing turning of said apparatus when said second end of said baseplate shaft is secured in a chuck of said electric hand drill to rotate said brush means and with said hand drill positioned between said legs and said screws engaging sides of said hand drill and providing that said apparatus may be separated from said hand drill by releasing said baseplate shaft from said chuck.

2. An apparatus as in claim 1 wherein said brush means are mounted on said first side of said baseplate.

3. An apparatus as in claim 1 which further comprises a reamer attachable to said first end of said baseplate shaft.

4. An apparatus as in claim 1 wherein said tube has an interior and an exterior surface and said plurality of brush means includes:

a set of internal brushes, each comprising bristles extending radially outward from an axis aligned end to end with said stem providing that said interior surface of said tube may be brushed by inserting one of said interior brushes inside said tube; and a set of external brushes, each comprising a cylinder having an inner surface with bristles attached at one end to said inner surface and extending radially inward toward an axis aligned end to end with said stem at a closed end of said cylinder and an open end of said cylinder where said tube is inserted for brushing.

5. An apparatus as in claim 4 wherein:

each said internal brush has a diameter operably chosen to accommodate brushing a tube having a standard inside diameter;

each said external brush has an inner diameter operably chosen to accommodate brushing a tube having a standard outside diameter.

6. An apparatus as in claim 1 wherein said means for coupling said shaft to said stems comprises:

a plurality of cylindrical sleeves, each having a length and a bore extending said length and each sleeve perpendicularly oriented to and journalled onto said base plate providing that one of said stems may be securely positioned in each bore;

a plurality of sleeve gears, one sleeve gear mounted onto one of each said sleeves;

a shaft gear journalled through said baseplate shaft and operably engaged with each of said sleeve gears whereby said sleeves rotate when said baseplate shaft rotates.

7. An apparatus as in claim 1 wherein said means for coupling said shaft to said stems comprises a plurality of cylindrical sleeves, each having a length and a bore extending said length and each sleeve perpendicular to and journalled onto said base plate providing that one of said stems may be securely positioned in each bore;

a plurality of sleeve gears, one stem gear mounted onto one of each said sleeves;

a shaft gear mounted onto said shaft;

a group of idler gears rotatably mounted onto said base plate, each idler gear operably engaged with said shaft gear and at least one of said sleeve gears thereby providing that said sleeve gears and brushes turn when said baseplate shaft turns.

8. An apparatus as in claim 7 wherein:

said sleeves and gears are all positioned on said first side of said baseplate; and said apparatus further comprises;

a cover plate;

a skirt having a first edge secured around an outside edge of said cover plate and a second edge secured around an edge of said base plate thereby housing said gears and operably aligning said plates with respect to one another to provide that said sleeves are journalled in said baseplate and said cover plate permitting said brush stems to be inserted into said bores of said stems.

9. An apparatus on which a plurality of brush means may be mounted and rotated to deburr and clean ends of tubes wherein each brush means has a cylindrical brush portion attached coaxially to a stem wherein said apparatus comprises:

a baseplate having a first and second side;

a plurality of sleeves, each sleeve journalled into said first side of said baseplate;

each sleeve having a bore extending from a first end of said sleeve into which said stems may be inserted;

a baseplate shaft journalled substantially into a center of said base plate and having a first and a second end extending from said first and second sides of said baseplate respectively;

means for rotatably coupling said baseplate shaft to said sleeves to provide that said sleeves rotate continuously when said baseplate shaft rotates continuously;

a means for slidably engaging comprising, a first leg having an end attached to said second side of said base plate and a first free end extending away from said second side with a set screw in said first leg near said first free end oriented perpendicular to said base plate shaft.

a second leg having an end attached to said second side of said baseplate and a second free end extending away from said second side with a set screw in said second leg near said second free end oriented perpendicular to said baseplate shaft thereby preventing turning of said apparatus when said electric hand drill is positioned between said legs with said screws engaged with sides of said hand drill and said second end of said baseplate shaft is secured in a chuck of said electric hand drill to rotate said brush means and providing that said apparatus may be separated from said hand drill by releasing said baseplate shaft from said chuck.

10. An apparatus as in claim 9 wherein said means for coupling said baseplate shaft to said sleeves further comprises:

a gear mounted on each sleeve;

a gear mounted on said base plate shaft engaged with each said sleeve gear.

11. An apparatus as in claim 9 wherein said coupling means further comprises:

a gear on each said sleeve;

a gear on said base plate shaft;

a plurality of idler gears rotatably journalled on said first side of said base plate, each one idler gear rotatably engaged with said shaft gear and with one said sleeve gear.

12. An apparatus as in claim 9 which further comprises;

a cover plate opposed to said first side of said baseplate a skirt having a first edge engaged with an edge of said baseplate and a second edge engaged with an edge of said cover plate thereby forming a housing that encloses said coupling means;

said sleeves, idler gears and baseplate shaft journalled to said cover plate.

13. An apparatus as in claim 4 wherein said means for slidably engaging detachably engaging means comprises a U bracket having two legs, each having said a first end connected to an end of a connecting member and a free end with a threaded hole oriented perpendicular to said baseplate shaft and a set screw positioned in said threaded hole wherein said connecting member is secured to said baseplate on said second side operably arranged to provide that said electric hand drill may be securely positioned between said legs by set screws.

* * * * *